US009522802B2

(12) United States Patent
Romas et al.

(10) Patent No.: US 9,522,802 B2
(45) Date of Patent: Dec. 20, 2016

(54) WINDING APPARATUS AND WINDING METHOD

(71) Applicant: KABUSHIKI KAISHA TOSHIBA, Minato-ku (JP)

(72) Inventors: Aisar Labibi Romas, Yokohama (JP); Hirokazu Okamoto, Yokohama (JP); Chiayu Lin, Yokohama (JP); Yosuke Shimizu, Yokohama (JP); Kei Koyanagi, Yokohama (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 337 days.

(21) Appl. No.: 14/206,140

(22) Filed: Mar. 12, 2014

(65) Prior Publication Data

US 2015/0090830 A1 Apr. 2, 2015

(30) Foreign Application Priority Data

Sep. 30, 2013 (JP) ..... 2013-205960

(51) Int. Cl.
*B65H 54/10* (2006.01)
*B65H 54/28* (2006.01)

(52) U.S. Cl.
CPC ..... *B65H 54/2803* (2013.01); *B65H 54/2851* (2013.01); *B65H 54/2884* (2013.01); *B65H 2701/36* (2013.01)

(58) Field of Classification Search
CPC ..... B65H 54/10; B65H 54/22; B65H 54/2851; H05K 7/1432; B29C 53/56; B29C 53/58; B29C 53/68; B29C 53/72; B29C 53/821
See application file for complete search history.

(56) References Cited

U.S. PATENT DOCUMENTS 2,481,619 A * 9/1949 Roessel ..... B65H 54/10 242/479.4
3,017,129 A * 1/1962 Trost ..... B65H 54/22 242/474.2

(Continued)

FOREIGN PATENT DOCUMENTS

CN 1127418 A 7/1996
CN 1178510 A 4/1998

(Continued)

OTHER PUBLICATIONS

Combined Chinese Office Action and Search Report issued May 18, 2016 in Patent Application No. 201210450337.2 (with English Translation).

(Continued)

*Primary Examiner* — Emmanuel M Marcelo
(74) *Attorney, Agent, or Firm* — Oblon, McClelland, Maier & Neustadt, L.L.P.

(57) ABSTRACT

According to one embodiment, winding apparatus includes a bobbin, a core, a pressing section, a moving unit, a first rotating unit, a second rotating unit and a control unit. The moving unit is configured to move the pressing section relatively to the core along each of first to third axes perpendicular to each other. The first rotating unit is configured to rotate the pressing section relatively to the core around fourth and fifth axes perpendicular to each other, and set on the core. The second rotating unit is configured to rotate the pressing section relatively to the core around a sixth axis which becomes parallel to, when the core is in an initial position at which the fourth and fifth axes become parallel to any two of the first to third axes, a remaining one of the first to third axes.

6 Claims, 7 Drawing Sheets

(56) References Cited

U.S. PATENT DOCUMENTS

| | | | | | |
|---|---|---|---|---|---|
| 3,029,031 | A * | 4/1962 | Furst | B65H 54/14 | 242/475.8 |
| 3,123,968 | A * | 3/1964 | Flanigan | B65H 54/10 | 242/156 |
| 4,202,512 | A * | 5/1980 | Nicholson, Jr. | B65H 54/2851 | 242/157.1 |
| 5,662,289 | A * | 9/1997 | Ujita | H01F 41/122 | 242/444.5 |
| 6,145,196 | A * | 11/2000 | Ripstein | B05C 17/0207 | 156/187 |
| 6,311,389 | B1 * | 11/2001 | Uosaki | G01R 33/3858 | 29/605 |
| 6,499,689 | B1 * | 12/2002 | Miyazaki | H01F 41/082 | 242/411 |
| 7,741,944 | B2 | 6/2010 | Leghissa et al. | | |
| 2005/0236509 | A1 * | 10/2005 | Burch | H02K 15/095 | 242/432.4 |
| 2009/0278647 | A1 * | 11/2009 | Buswell | H01F 3/06 | 336/182 |
| 2012/0280073 | A1 * | 11/2012 | Tomita | B65H 55/04 | 242/174 |

FOREIGN PATENT DOCUMENTS

| | | |
|---|---|---|
| CN | 1335630 A | 2/2002 |
| JP | 2008-28147 | 2/2008 |

OTHER PUBLICATIONS

Combined Chinese Office Action and Search Report issued May 18, 2016 in Patent Application No. 201410450337.2 (with English Translation).

* cited by examiner

WINDING APPARATUS AND WINDING METHOD

CROSS-REFERENCE TO RELATED APPLICATION

This application is based upon and claims the benefit of priority from Japanese Patent Application No. 2013-205960, filed Sep. 30, 2013; the entire contents of which are incorporated herein by reference.

FIELD

Embodiments described herein relate generally to a winding apparatus configured to wind, for example, a belt-like wire around a bobbin, and a method of winding, for example, a belt-like wire around a bobbin.

BACKGROUND

A winding apparatus configured to form a saddle-type coil by winding a belt-like wire around a saddle-like core is proposed. A winding apparatus of this kind is provided with a mechanism configured to rotate a saddle-like bobbin, and a mechanism configured to move a head used to position a wire on the coil bobbin in the longitudinal direction. In this way, it is made possible to make the head carry out a follow-up action along the circumferential surface of the bobbin by moving the head along one axis, and rotating the bobbin around the axis.

DETAILED DESCRIPTION

According to one embodiment, winding apparatus includes a bobbin, a core on which the bobbin is to be fixed, a pressing section, a moving unit, a first rotating unit, a first rotating unit, a second rotating unit and a control unit.

The pressing section is configured to press a wire against the bobbin. The moving unit is configured to move the pressing section relatively to the core along each of first to third axes perpendicular to each other. The first rotating unit is configured to rotate the pressing section relatively to the core around fourth and fifth axes perpendicular to each other, and set on the core. The second rotating unit is configured to rotate the pressing section relatively to the core around a sixth axis which becomes parallel to, when the core is in an initial position at which the fourth and fifth axes become parallel to any two of the first to third axes, a remaining one of the first to third axes. The control unit is configured to control an operation of the moving unit, and operations of the first and second rotating units.

Figure 1:
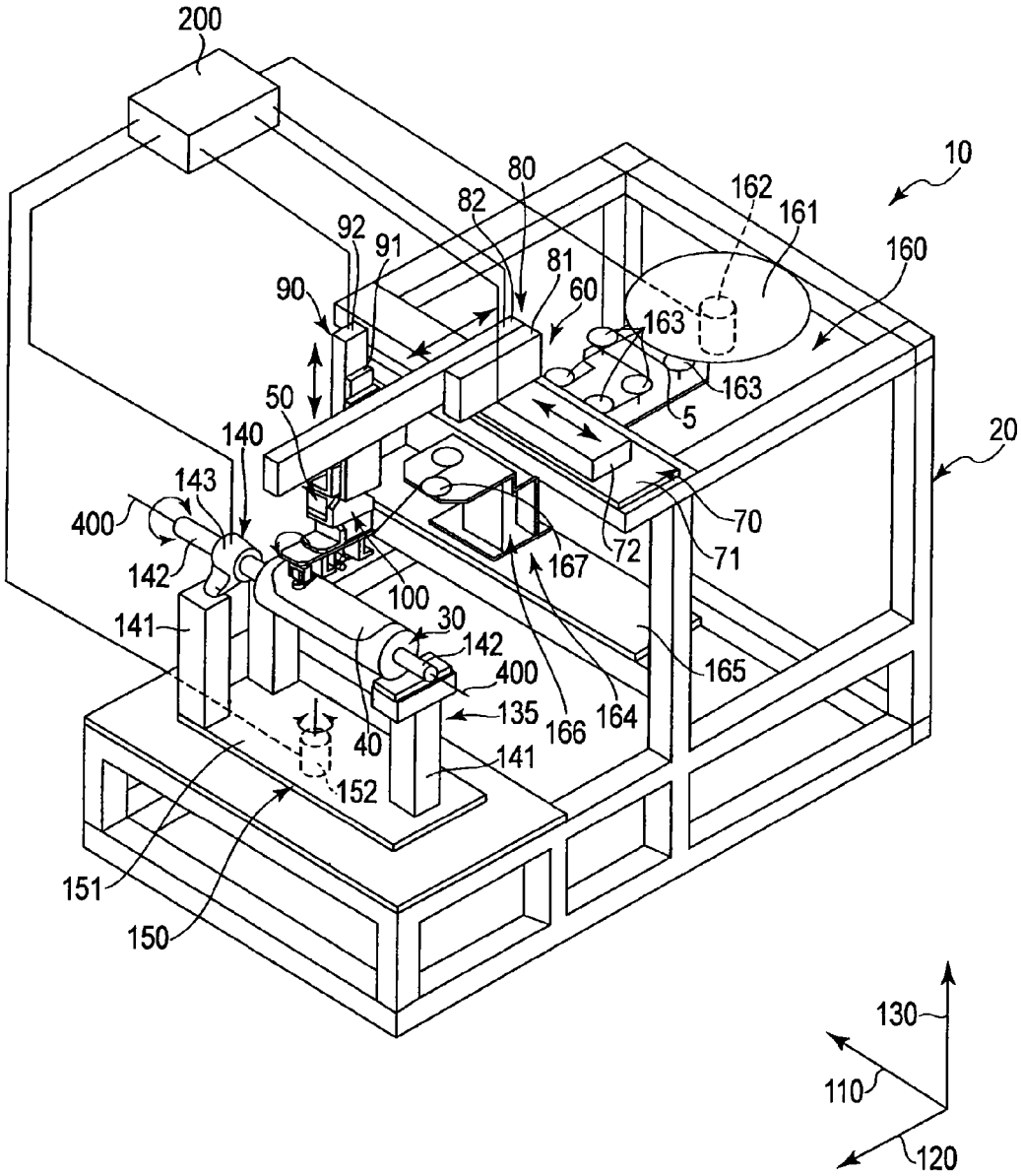
FIG. 1 is a perspective view showing a winding apparatus according to a first embodiment.

A winding apparatus, and winding method according to a first embodiment will be described below by using FIGS. 1 to 12. FIG. 1 is a perspective view showing a winding apparatus 10. As shown in FIG. 1, the winding apparatus 10 is provided with a framework 20, core 30, bobbin 40, head 50, head moving unit 60, core rotating unit 135, and wire feeding unit 160. The head moving unit 60 is an example of moving unit.

Figure 2:
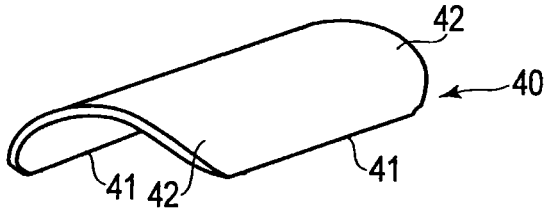
FIG. 2 is a perspective view showing a bobbin of the winding apparatus.

The winding apparatus 10 is formed in such a manner that the winding apparatus 10 can wind a wire 5 around the circumferential surface of the bobbin 40 fixed on the core 30. The winding mentioned herein implies winding the wire 5 around the bobbin 40. The wire 5 has a belt-like shape. FIG. 2 is a perspective view showing the bobbin 40. As shown in FIG. 2, the bobbin 40 has a curved shape, and is formed into a saddle-like shape. The bobbin 40 is a so-called saddle-type bobbin.

Figure 3:
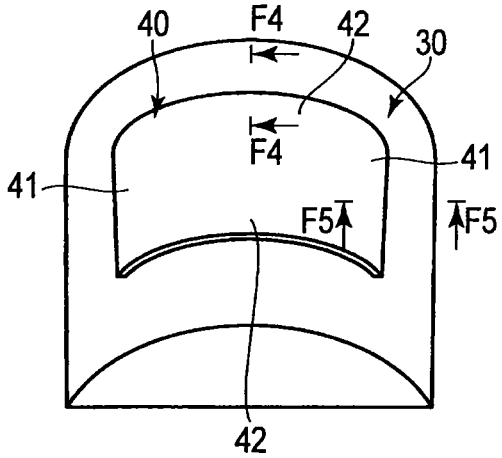
FIG. 3 is a perspective view showing a part at which the bobbin is fixed on a core of the winding apparatus, and the periphery of the part in an enlarged manner.

As shown in FIG. 1, the bobbin 40 is fixed on the circumferential surface of the core 30. The core 30 has a cylindrical shape conforming to the bobbin 40 formed into the saddle-like shape. FIG. 3 is a perspective view showing a part at which the bobbin 40 is fixed on the core 30, and the periphery of the part in an enlarged manner.

As shown in FIGS. 1 and 3, the bobbin 40 includes straight parts 41 each extending on the circumferential surface of the core 30 along a central axis 400 of the core 30, and a curved part 42 extending on the circumferential surface of the core 30 in the circumferential direction of the central axis of the core 30. The planar shape of the bobbin 40 is a rectangular shape. Ends of the pair of straight parts 41 of the bobbing 40 are connected to each other by the curved part 42, whereby the planar shape of the bobbin 40 is made rectangular.

Figure 4:
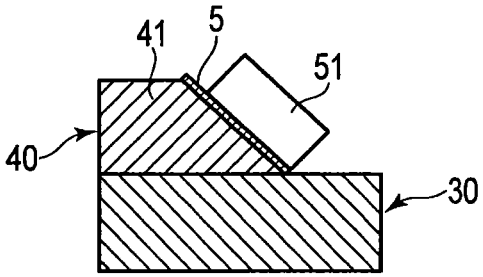
FIG. 4 is a cross-sectional view of the core and bobbin showing the cross section along line F4-F4 shown in FIG. 3.

FIG. 4 is a cross-sectional view of the core and bobbin showing the cross section along line F4-F4 shown in FIG. 3. FIG. 4 shows a state where the bobbin 40, and core 30 are cross-sectioned at the curved part 42. As shown in FIG. 4, the circumferential surface of the curved part 42 rises from the circumferential surface of the core 30 in such a manner that an angle formed between the circumferential surface of the curved part 42, and core 30 becomes an obtuse angle.

Figure 5:
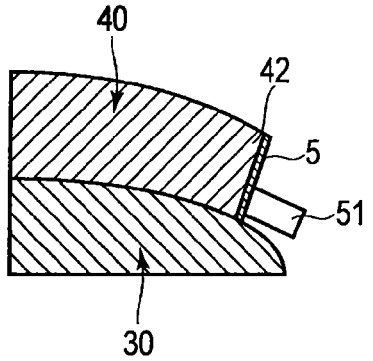
FIG. 5 is a cross-sectional view of the core and bobbin showing the cross section along line F5-F5 shown in FIG. 3.

FIG. 5 is a cross-sectional view of the core 30 and bobbin 40 showing the cross section along line F5-F5 shown in FIG. 3. FIG. 5 shows a state where the core 30, and bobbin 40 are cross-sectioned at the straight part 41. As shown in FIG. 5, the circumferential surface of the straight part 41 rises from the circumferential surface of the core 30 substantially at right angles. The circumferential surface of the bobbin 40 is formed as described above so that winding of the wire 5 can be carried out without forming a kink or a bend in the belt-like wire 5, and hence is formed into a complex shape.

As shown in FIG. 1, the framework 20 is formed in such a manner that the head moving unit 60, core rotating unit 135, and wire feeding unit 160 which are to be described later can be fixed thereto.

As shown in FIG. 1, the head 50 is formed in such a manner that the head 50 can position the wire 5 on the circumferential surface of the bobbin 40, and press the wire 5 against the circumferential surface of the bobbin 40. The structure of the head 50 will be specifically described later.

The head moving unit 60 is formed in such a manner that the head moving unit 60 can move the head 50 along first to third axes 110, 120, and 130 which are set to the framework 20, and rotate the head 50 around the first axis 110. The first to third axes intersect each other at right angles. The third axis 130 is, in this embodiment, as an example, an axis in a direction parallel to the vertical direction. The head moving unit 60 is provided with a first moving unit 70, second moving unit 80, third moving unit 90, and head rotating unit 100. The head rotating unit 100 is an example of second rotating unit.

The first moving unit 70 includes a first rail 71, and first moving section 72. The first rail 71 is fixed to the framework 20. The first rail 71 extends parallel to the first axis 110. The first moving section 72 is mounted on the first rail 71 in such a manner that the first moving section 72 can be moved along the first rail 71. The first moving section 72 includes a drive section such as a motor or the like. The drive of the drive section is controlled by a control unit 200 to be described later. The control unit 200 is an example of a control section. When the drive section is driven, the first moving section 72 is moved along the first rail 71.

The second moving unit 80 includes a second rail 81, and second moving section 82. The second rail 81 is fixed to the first moving section 72. The second rail 81 extends parallel to the second axis 120. The second rail 81 is moved together with the first moving section 72. The second moving section 82 is mounted on the second rail 81 in such a manner that the second moving section 82 can be moved along the second rail 81. The second moving section 82 includes a drive section such as a motor or the like. The drive of the drive section is controlled by the control unit 200 to be described later. When the drive section is driven, the second moving section 82 is moved along the second rail 81.

The third moving unit 90 includes a third rail 91, and third moving section 92. The third rail 91 is fixed to the third moving section 92. The third rail 91 extends parallel to the third axis 130. The third moving section 92 is mounted on the third rail 91 in such a manner that the third moving section 92 can be moved along the third rail 91. The third moving section 92 includes a drive section such as a motor or the like. The drive of the drive section is controlled by the control unit 200 to be described later. When the drive section is driven, the third moving section 92 is moved along the third rail 91.

The head 50 is fixed to a lower end part of the third moving section 92 through the head rotating unit 100 to be described later. The first moving section 72 of the first moving unit 70 is moved, whereby the head 50 is moved in a direction parallel to the first axis 110. The second moving section 82 of the second moving unit 80 is moved, whereby the head 50 is moved in a direction parallel to the second axis 120. The third moving section 92 of the third moving unit 90 is moved, whereby the head 50 is moved in a direction parallel to the third axis 130.

Figure 6:
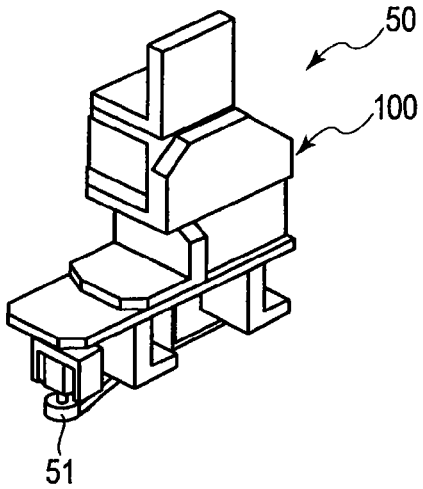
FIG. 6 is a perspective view showing a head of the winding apparatus.

FIG. 6 is a perspective view showing the head 50 in an enlarged manner. As shown in FIGS. 1 and 6, the head rotating unit 100 is provided to be integral with the head 50, and couples the head 50 to the third moving section 92. The head rotating unit 100 is formed in such a manner that the head rotating unit 100 can swing the head 50 around the first axis 110 by the control of the control unit 200 to be described later.

The core rotating unit 135 is arranged at a position below the head 50 along the third axis 130. The core rotating unit 135 is an example of a first rotating unit. The core rotating unit 135 includes a first rotating unit 140, and second rotating unit 150. The first rotating unit 140 is an example of a first rotating section. The second rotating unit 150 is an example of a second rotating section.

The first rotating unit 140 is provided with a pair of rotating shaft support sections 141, rotating shaft 142, and first core rotating unit drive section 143. The rotating shaft 142 is provided along the central axis 400 of the core 30. The rotating shaft 142 protrudes from each of both ends of the core 30, and extends along the central axis 400 of the core 30.

The one rotating shaft support section 141 is formed in such a manner that the one rotating shaft support section 141 can rotatably support one end part of the rotating shaft 142. The other rotating shaft support section 141 is formed in such a manner that the other rotating shaft support section 141 can rotatably support the other end part of the rotating shaft 142. The first core rotating unit drive section 143 is provided in the one rotating shaft support section 141. The first core rotating unit drive section 143 is formed in such a manner that the first core rotating unit drive section 143 can rotate the rotating shaft 142 by the control of the control unit 200.

The second rotating unit 150 includes a rotating table 151 on which both the rotating shaft support sections 141 are fixed, and second core rotating unit drive section 152. In this embodiment, the second core rotating unit drive section 152 is arranged below the rotating table 151, and hence is indicated by dotted lines in FIG. 1. The second core rotating unit drive section 152 is formed in such a manner that the second core rotating unit drive section 152 can rotate the rotating table 151 around the third axis 130 by the control of the control unit 200 to be described later. In a state where the core 30 is supported on the framework 20 with the first and second rotating units 135, and 150, the rotating shaft 142 intersects the third axis 130 at right angles.

The wire feeding unit 160 is formed in such a manner that the wire feeding unit 160 can feed the wire 5 to the head 50. The wire feeding unit 160 is arranged at a position separate from the core 30 along the second axis 120 with the head 50, and head moving unit 60 interposed between the core 30, and wire feeding unit 160. The wire feeding unit 160 includes a wire retention roller 161 around which the wire 5 is wound, roller drive section 162, a plurality of rollers 163, and feed position adjusting unit 164. The feed position adjusting unit 164 is provided with a movement rail 165, and feed position moving section 166. The feed position moving section 166 is an example of a wire feeding section moving section.

The movement rail 165 is provided at a position separate from the head 50 along the second axis 120. The movement rail 165 extends along the first axis 110. The feed position moving section 166 is mounted on the movement rail 165 in such a manner that the feed position moving section 166 can be moved along the movement rail 165. The feed position moving section 166 includes a drive section such as a motor or the like. This drive section moves the feed position moving section 166 along the movement rail 165 by the control of the control unit 200 to be described later. The feed position moving section 166 includes a feed roller 167. The feed roller 167 is an example of a wire feeding section. The feed roller 167 is formed rotatable around the third axis 130.

The wire retention roller 161 is formed rotatable around the third axis 130. The roller drive section 162 is formed in such a manner that the roller drive section 162 can rotate the wire retention roller 161 by the control of the control unit 200 to be described later. A plurality of rollers 163 are arranged in line between the wire retention roller 161, and feed position adjusting unit 164 in a direction in which the second axis 120 extends.

The wire 5 stored on the wire retention roller 161 by being wound around the roller 161 is fed to the head 50. The part of the wire 5 between the head 50, and wire retention roller 161 is set along the circumferential surfaces of the feed roller 167, and the plurality of rollers 163.

By applying torque to the wire retention roller 161 in such a manner that the roller drive section 162 is rotated in a direction opposite to the direction in which the wire 5 is paid out from the wire retention roller 161, the part of the wire 5 between the head 50, and wire retention roller 161 is brought into a tightened state, whereby the part of the wire 5 is prevented from slackening. It should be noted that as described above, the roller drive section 162 is an example of a slack prevention unit used to prevent the part of the wire 5 between the head 50, and wire retention roller 161 from slackening. It should be noted that the above-mentioned urging torque in the opposite direction to be applied to the wire retention roller 161 by the roller drive section 162 is not so great as to prevent the wire 5 from being paid out of the wire retention roller 161.

Figure 7:
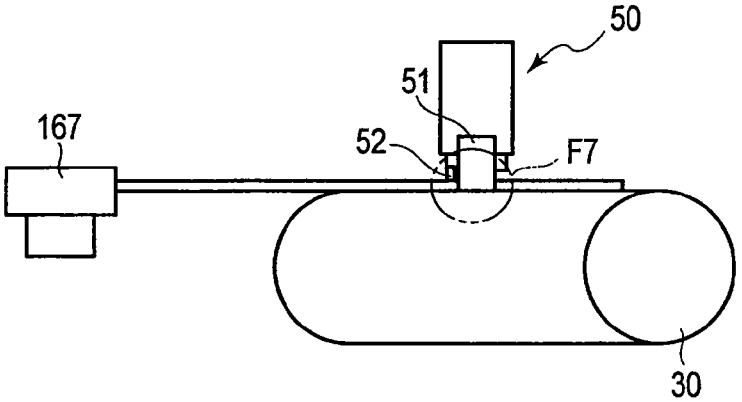
FIG. 7 is a schematic view showing the head, core, and feed roller of a wire feeding unit of the winding apparatus.
Figure 8:
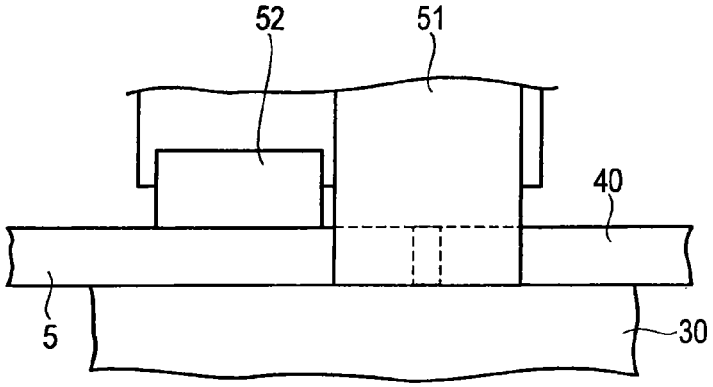
FIG. 8 is a schematic view showing the range F7 shown in FIG. 7 in an enlarged manner.

Here, the head 50 will be specifically described below. FIG. 7 is a schematic view showing the head 50, core 30, and feed roller 167. FIG. 8 is a schematic view showing the range F7 shown in FIG. 7 in an enlarged manner. As shown in FIGS. 6 to 8, the head 50 is provided with a pressing section 51, and guide section 52. As shown in FIG. 8, the pressing section 51 is formed in such a manner that the pressing section 51 can press the wire 5 against the circumferential surface of the bobbin 40. The wire 5 is held between the pressing section 51, and bobbin 40 by being pressed against the bobbin 40 by the pressing section 51. In this embodiment, the pressing section 51 is a roller formed freely rotatable. The wire 5 is held between the circumferential surface of the bobbin 40, and pressing section 51.

The guide section 52 is provided at a position separate from the circumferential surface of the core 30 by such a space that the wire 5 can be held therein. The wire 5 is held between the guide section 52, and circumferential surface of the core 30. It should be noted that the space between the guide section 52, and circumferential surface of the core 30 is set in such a manner that the wire 5 can slide on the guide section 52 and core 30 even if the friction is produced between the wire 5 and each of the guide section 52 and core 30 when the wire 5 is wound around the bobbin 40.

The control unit 200 includes first to fifth functions. The first function is a function of creating coordinate information about positions on the circumferential surface of the bobbin 40. The positions mentioned herein imply positions set in advance on the circumferential surface of the bobbin 40, and are, for example, a plurality of positions set at regular intervals along the circumferential surface.

Coordinates to be used herein will be described below. The coordinates to be used herein are coordinates indicating positions in the coordinate space defined by the first to third axes 110 to 130. A position along the first axis 110 is expressed by x. A position along the second axis 120 is expressed by y. A position along the third axis 130 is expressed by z.

Coordinates of each position on the circumferential surface of the bobbin 40 are the coordinates of a state where the bobbin 40 is in the initial position in the coordinate space defined by the first to third axes 110 to 130. The initial position of the bobbin 40 is a position of the bobbin 40 in the state where the bobbin 40 is fixed on the core 30, and further in the state where the core rotating unit 135 is in the initial state.

The initial position of the core rotating unit 135 is the position of the core rotating unit 135 in the state where each of the first and second rotating units 140, and 150 is in the initial position, and further in this embodiment, in the state where the central axis of the core 30 is parallel to the first axis 110, and the center of the bobbin 40 is in the uppermost position along the third axis 130.

In this embodiment, the control unit 200 creates coordinate information about the bobbin 40 on the basis of, for example, design information to be used when the bobbin 40 is formed such as CAD information.

The second function is a function of creating coordinate information about each of the positions on the circumferential surface of each layer of the wire 5 wound around the bobbin 40. As shown in FIGS. 3, and 4, the pressing section 51 of the head 50 presses the wire 5 against each position of the bobbin 40 on the basis of coordinate information about each position of the bobbin 40. FIGS. 3, 4 each show the state where the wire 5 is wound around the bobbin 40 once.

Figure 10:
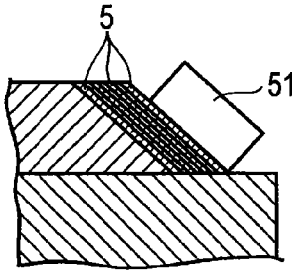
FIG. 10 is a cross-sectional view showing a state where the wire is wound around the bobbin a number of times in the same cross-sectioned state as FIG. 4.
Figure 11:
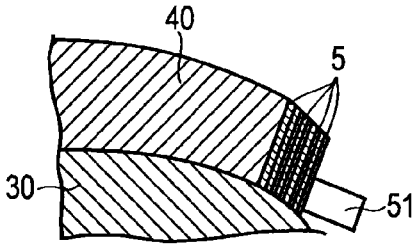
FIG. 11 is a cross-sectional view showing a state where the wire is wound around the bobbin a number of times in the same cross-sectioned state as FIG. 5.

FIGS. 10 and 11 each show the state where the wire 5 is formed into a plurality of laminated layers on the circumferential surface of the bobbin 40 by being wound around the bobbin 40 a plural number of times. FIG. 10 is a cross-sectional view showing the state where the wire 5 is wound a plural number of times, and cross-sectioned in the same manner as FIG. 4. FIG. 11 is a cross-sectional view showing the state where the wire 5 is wound a plural number of times, and cross-sectioned in the same manner as FIG. 5.

As shown in FIGS. 10, and 11, when the wire 5 has been wound a plural number of times, the pressing section of the head 50 presses the wire 5 not against the circumferential surface of the bobbin 40, but against the circumferential surface of the already wound wire 5.

Accordingly, in order that the pressing section 51 of the head 50 may press the wire 5 against an appropriate position of the circumferential surface of the wire 5 in the state where the lower end of the wire 5 is in contact with the surface of the core 30, i.e., in the state where the wire 5 is laminated in accordance with the shape of the surface of the core 30, the control unit 200 creates coordinate information about each position of the circumferential surface of the wire 5 wound around the circumferential surface of the bobbin 40.

The coordination information about each of the positions of the surface of each layer of the wire 5 in the case where the wire 5 is wound around the bobbin 40 a plural number of times is calculated on the basis of information about the thickness of the wire 5, number of times of winding, and shape of the surface of the core 30. The number of times the wire 5 is wound around the bobbin 40 is determined in advance.

The control unit 200 creates coordinate information about each of the positions of the circumferential surface of the wire 5 wound around the bobbin 40 on the basis of the calculated coordinate information about each of the positions of the circumferential surface of the bobbin 40, information about the thickness of the wire 5, shape information about the circumferential surface of the core 30, and information about the number of times the wire 5 is wound.

It should be noted that the coordinate information about each of the positions of the wire 5 wound around the bobbin 40 is determined in such a manner that the lower end of the wire 5 is in contact with the surface of the core 30. Accordingly, as shown in FIGS. 10 and 11, the lower end of the wire 5 wound a plural number of times comes in contact with the surface of the core 30. The control unit 200 creates coordinate information about each of the positions of the circumferential surface of the wire 5 on each layer of the wire 5 wound around the bobbin 40.

The third function is a function of creating an operation recipe for operating the head moving unit 60, and core rotating unit 135 on the basis of the created coordinate information about each of the positions of the circumferential surface of the bobbin 40, and coordinate information about each of the positions of the circumferential surface of each layer of the wire 5 wound around the bobbin 40. The fourth function is a function of moving the head 50 to a target position of the circumferential surface of the bobbin 40 or a target position of the circumferential surface of the wire 5 wound around the bobbin 40 by controlling the head moving unit 60 and core rotating unit 135 in accordance with the operation recipe.

At this time, when the wire 5 is wound around the circumferential surface of the bobbin 40, the control unit 200 controls the head rotating unit 100 in such a manner that the wire 5 follows the circumferential surface of the bobbin 40. Likewise, when the wire 5 is wound around the wire 5 already wound around the bobbin 40, the control unit 200 controls the head rotating unit 100 in such a manner that the wire 5 follows the circumferential surface of the wire 5 wound around the bobbin 40.

It should be noted that hereinafter it is assumed that winding the wire 5 around the bobbin 40 includes forming a laminated structure of the wire 5 on the circumferential surface of the bobbin 40 around which no wire 5 is wound, and winding the wire 5 around the wire 5 on the bobbin 40 around which the wire 5 is already wound. Further, likewise, it is assumed that an operation to be carried out with respect to the bobbin 40 includes an operation to be carried out with respect to the wire 5 wound around the bobbin 40. Further, likewise, it is assumed that the target position of the bobbin 40 includes the target position of the wire 5 wound around the bobbin 40. Further, likewise, it is assumed that each of the positions of the bobbin 40 includes each of the positions of the wire 5 wound around the bobbin 40.

The fifth function is a function of controlling the feed position adjusting unit 164 when the wire 5 is to be wound around the bobbin 40. More specifically, the feed position moving section 166 is moved in such a manner that the part of the wire 5 between the pressing section 51 and feed roller 167 is in the tangential direction of the part of the bobbin 40 at which the pressing section 51 is pressed against the bobbin 40 in accordance with the state of the bobbin 40 rotated by the core rotating unit 135. The feed position moving section 166 is moved, whereby the feed roller 167 is moved.

More specifically, when the wire 5 is to be wound around the curved part 42 of the bobbin 40, the control unit 200 carries out the operation described above. This operation will be specifically described below.

Figure 12:
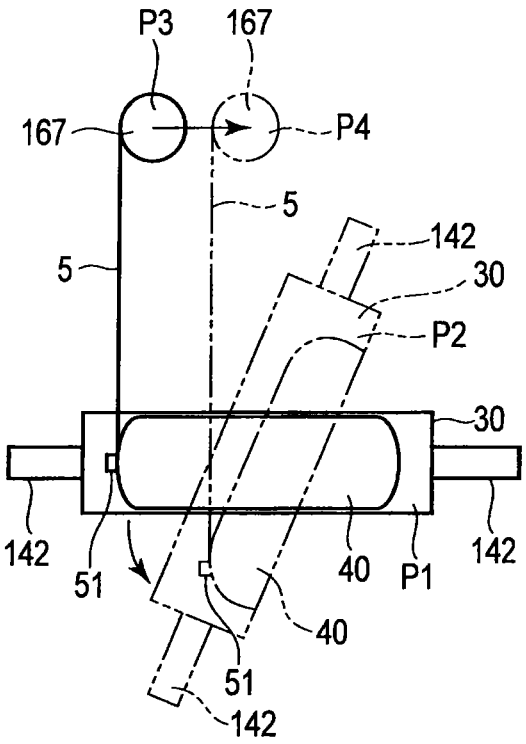
FIG. 12 is an explanatory view showing a state where the feed roller is moved in accordance with the rotation of the bobbin.

FIG. 12 shows a state where the feed roller 167 is moved in accordance with the rotation of the bobbin 40. Here, the case where the bobbin 40 is rotated from the first position P1 indicated by solid lines to the second position P2 indicated by two-dot chain lines will be described below as an example. At this time, the feed roller 167 is moved from the third position P3 indicated by solid lines to the fourth position P4 indicated by two-dot chain lines.

The third position P3 is a position at which the part of the wire 5 from the feed roller 167 to the pressing section 51 becomes parallel to the tangential direction of the part of the bobbin 40 at which the pressing section 51 is pressed against the bobbin 40 when the bobbin 40 is in the first position P1. The fourth position P4 is a position at which the part of the wire 5 from the feed roller 167 to the pressing section 51 becomes parallel to the tangential direction of the part of the bobbin 40 at which the pressing section 51 is pressed against the bobbin 40 when the bobbin 40 is in the second position P2.

The feed roller 167 is moved from the third position P3 to the fourth position P4, whereby the wire 5 is kept in a posture parallel to the tangential line of the curved part 42 when the bobbin 40 is rotated from the first position P1 to the second position P2.

Next, an operation of the winding apparatus 10 will be described below. First, information about the shape of the bobbin 40, for example, design information such as CAD data or the like of the bobbin 40 is input to the control unit 200 by an operator or the like.

When the information about the shape of the bobbin 40 is input to the control unit 200, the control unit 200 creates coordinate information about each of the positions of the bobbin 40 in the state where the bobbin 40 is set to the initial position. Further, the control unit 200 creates coordinate information about each of the positions of each layer of the wire 5 on the basis of the thickness of the wire 5, and number of times the wire 5 is wound around the bobbin 40, i.e., the number of the layers of the wire 5 laminated on the bobbin 40.

Next, the control unit 200 creates an operation recipe for operating the head moving unit 60 and core rotating unit 135 on the basis of the coordinate information about each of the positions of the circumferential surface of the bobbin 40 and coordinate information about each of the positions of each layer of the wire 5 laminated on the bobbin 40 which are created in the manner described above in order to move the pressing section 51 of the head 50 to each of the positions of the circumferential surface of the bobbin 40, and each of the positions of the circumferential surface of the wire 5 wound around the bobbin 40.

Further, the control unit 200 creates an operation recipe for the feed position moving section 166 to be used when the wire 5 is wound around the curved part 42.

When the operation recipe for the head moving unit 60 and core rotating unit 135 is created, the operator fixes a distal end of the wire 5 to a fixing part set in advance to the bobbin 40. The fixing part is formed so that the distal end of the wire 5 can be fixed.

Figure 9:
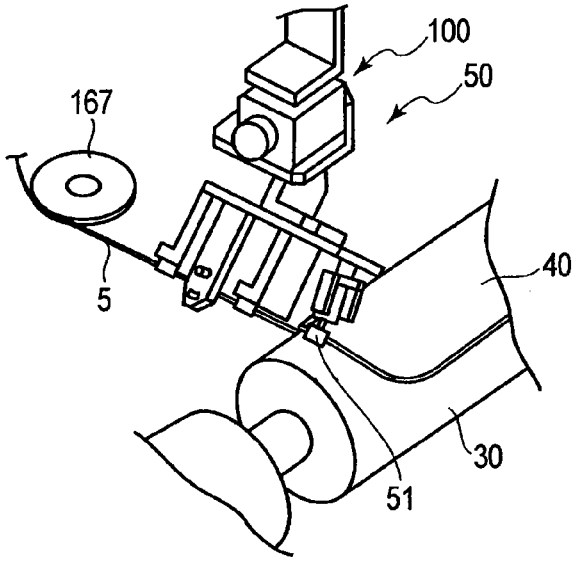
FIG. 9 is a perspective view showing a state where the wire is wound around the bobbin by the head.

When the distal end of the wire 5 is fixed to the bobbin 40, the control unit 200 operates the head moving unit 60, core rotating unit 135, and feed position moving section 166 in accordance with the created operation recipe. FIG. 9 is a perspective view showing the state where the wire 5 is wound around the bobbin 40. The head moving unit 60 and core rotating unit 135 are operated in accordance with the operation recipe, whereby the wire 5 is pressed against the circumferential surface by the pressing section 51 in the state where the posture of the wire 5 is fitted to the circumferential surface of the bobbin 40 or the circumferential surface of the wire 5 wound around the bobbin 40 as shown in FIGS. 4, 5, 10, and 11.

Further, when the wire 5 is wound around the bobbin 40, the upper end of the wire 5 is held down by the guide section 52 as shown in FIG. 8, whereby the wire 5 is wound around the bobbin 40 in the state where the lower end thereof is in contact with the circumferential surface of the core 30 as shown in FIGS. 4, 5, 10, and 11. That is, the wire 5 is wound around the bobbin 40 while following the circumferential surface of the core 30.

The winding apparatus 10 configured in the manner described above is provided with the head moving unit 60, and core rotating unit 135, whereby the winding apparatus 10 can adjust the position of the wire 5 relative to the bobbin 40 on six axes. More specifically, it is possible to rotate the position of the pressing section 51 relative to the bobbin 40 around the central axis of the core 30, and first and third axes 110, and 130. Further, it is possible to move the wire 5 along the first to third axes 110 to 130 relatively to the bobbin 40.

As described above, by adjusting the position of the wire 5 relative to the bobbin 40 on six axes, it is possible to wind the wire 5 around the circumferential surface of the bobbin 40 having a complicated shape in a state where the wire 5 is in surface contact with the circumferential surface of the bobbin 40.

Further, the core rotating unit 135 has a function of carrying out rotation of the pressing section 51 relative to the bobbin 40 around the third axis 130, and rotation of the core 30 around the central axis thereof, and the head moving unit 60 includes a mechanism configured to carry out movement of the pressing section 51 relative to the bobbin 40 along the first to third axes 110 to 130, and rotation of the pressing section 51 of the head 50 relative to the bobbin 40 around the first axis 110.

As described above, by dividing the mechanism configured to adjust the position of the pressing section 51 relative to the bobbin 40 on six axes into two units, it is possible to simplify the structure of each unit.

Further, by moving the feed position moving section 166 when the wire 5 is to be wound around the curved part 42 of the bobbin 40, it is possible to prevent the wire 5 from deviating from the desirable winding position. This point will be specifically described below.

When the tangential direction of the position against which the pressing section 51 is pressed, and the part of the wire 5 between the feed roller 167 and pressing section 51 are not parallel to each other at the curved part 42, the wire 5 comes in contact with the bobbin 40 or the already wound part of the wire 5 at a position deviating from the pressing section 51. This contact position differs from the position at which the wire 5 is to be wound in some cases. This is because the bobbin 40 has a complicated shape.

Conversely, in this embodiment, the part of the wire 5 between the pressing section 51 and feed roller 167 does not come in contact with the bobbin 40 or the already wound part of the wire 5 at a part other than the part at which the wire 5 is pressed by the pressing section 51 owing to the movement of the feed position moving section 166. Accordingly, the part of the wire 5 between the feed roller 167 and pressing section 51 is prevented from being wound at a position other than the position at which the wire 5 is to be wound.

Next, a winding apparatus according to a second embodiment will be described below by using FIGS. 13 to 19. It should be noted that each of the configurations with a function identical to the first embodiment is denoted by a reference symbol identical to the first embodiment, and a description thereof is omitted. In this embodiment, the function imparted to a control unit 200 differs from the first embodiment. Further, a wire feeding unit 160 does not include a feed position moving section 166. Other structures are identical to the first embodiment. The above-mentioned different points will be specifically described below.

In this embodiment, as creation of an operation recipe for a head moving unit 60, and creation of an operation recipe for a core rotating unit 135 both of which constitute the third function, the control unit 200 creates an operation recipe which makes it possible to wind a wire 5 around the circumferential surface of a bobbin 40 or the circumferential surface of the wire 5 wound around the bobbin 40 without moving a feed roller 167.

The control unit 200 creates, as the third function, rotation angle information about each of first and second rotating units 140 and 150 of a core rotating unit 135 in a case where the bobbin 40 is rotated from the initial position to a position of the optimum posture of the bobbin 40 to feed the wire 5 to a target position of the bobbin 40, coordinate information about the target position obtained after the rotation, and rotation information about a head rotating unit 100 configured to press the wire 5 against the target position obtained after the rotation.

The target position of the bobbin 40 is as explained in the first embodiment. The target position is a position on the circumferential surface at which a pressing section 51 of a head 50 is pressed against the circumferential surface.

The optimum posture of the bobbin 40 to feed the wire 5 to the target position of the bobbin 40 is a posture that makes the tangential direction of the target position of the circumferential surface and direction in which the part of the wire 5 from the feed roller 167 to the target position extends parallel to each other.

Here, creation of rotation angle information items θy and θz about the first and second rotating units 135 and 150 in the case where one of positions of the bobbin 40 is assumed to be the target position P10, and the target position P10 is rotated to the position of the optimum posture, creation of coordinate information about the target position obtained after the rotation and rotation angle information θx about the head rotating unit 100 will be described below by using FIGS. 10 to 16. It is assumed that the coordinates of the target position P10 of the bobbin 40 are (x1, y1, z1). It should be noted that the target position of the bobbin 40 is each of the positions obtained in the description of the first function.

Figure 13:
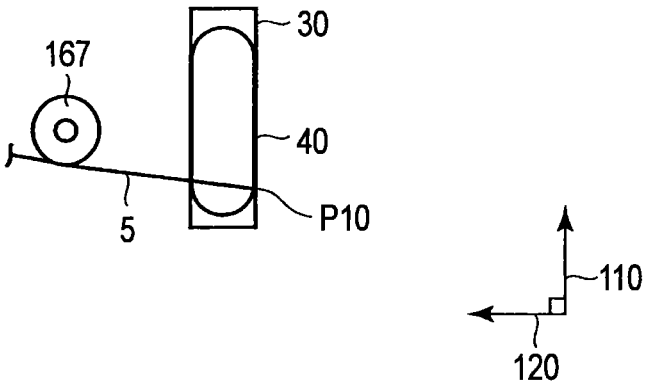
FIG. 13 is a plan view showing a state where a bobbin of a winding apparatus according to a second embodiment is in an initial position.
Figure 14:
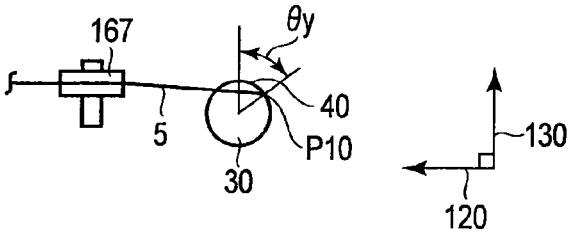
FIG. 14 is a view showing the core, bobbin, and feed roller of the winding apparatus along a first axis.

FIG. 13 is a plan view showing a state where the bobbin 40 is in an initial position. In FIG. 13, the bobbin 40, core 30, and feed roller 167 are schematically shown. FIG. 14 is a view showing the core 30, bobbin 40, and feed roller 167 shown in FIG. 13 along the first axis 110.

As shown in FIG. 14, θy is a rotation angle of the first rotating unit 140, and is a rotation angle of the bobbin 40 around the second axis 120 from the initial position. Further, θy is a rotation angle in a case where the target position P10 is rotated and raised to the uppermost position along the third axis 130.

Figure 15:
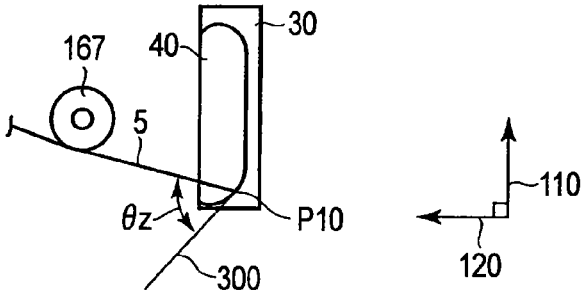
FIG. 15 is a plan view showing, in the same manner as FIG. 14, a posture of the bobbin in the case where the bobbin is rotated around a second axis from the initial position by a first rotating unit of the winding apparatus.
Figure 16:
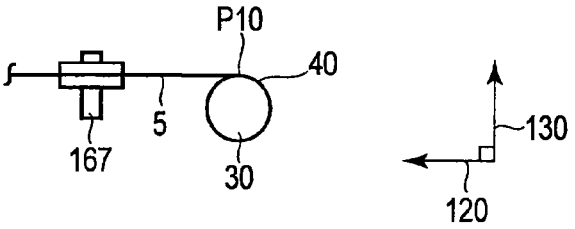
FIG. 16 is an explanatory view showing, along the second axis in the same manner as FIG. 14, a posture of the bobbin in the case where the bobbin is rotated around the second axis from the initial position by the first rotating unit.

FIG. 15 is a plan view showing, in the same manner as FIG. 13, a posture of the bobbin 40 in the case where the bobbin 40 is rotated around the second axis 120 from the initial position by the first rotating unit 140 by an angle θy. FIG. 16 is a view showing, along the second axis 120 in the same manner as FIG. 14, a posture of the bobbin 40 in the case where the bobbin 40 is rotated around the second axis 120 from the initial position by the first rotating unit 140 by an angle θy.

The angle of each of the positions of the circumferential surface of the bobbin 40 around the second axis 120 can be created on the basis of coordinate information about each of the positions. The control unit 200 creates a rotation angle of each of the positions from the angular position around the second axis 120 to the position at which each of the positions becomes the highest along the third axis 130.

Here, θz is a rotation angle of the second rotating unit 150, and is a rotation angle of the bobbin 40 around the third axis 130 from the initial position. Further, θz is a rotation angle in the case where the tangential direction 300 of the target position P10 is rotated to a position at which the tangential direction 300 of the target position P10 becomes parallel to the direction in which the part of the wire 5 from the feed roller 167 to the target position P10 extends. Further, θz is shown in FIG. 15.

An angular position of each of the positions of the circumferential surface of the bobbin 40, and each of the positions of the circumferential surface of each layer of the wire 5 wound around the bobbin 40 around the third axis can be created on the basis of coordinate information about each of the positions. The control unit 200 creates a rotation angle θz of each of the positions from the angular position around the third axis 130 to a position at which the tangential direction of the target position P10 becomes parallel to the direction in which the part of the wire 5 from the feed roller 167 to the target position P10 extends.

Figure 17:
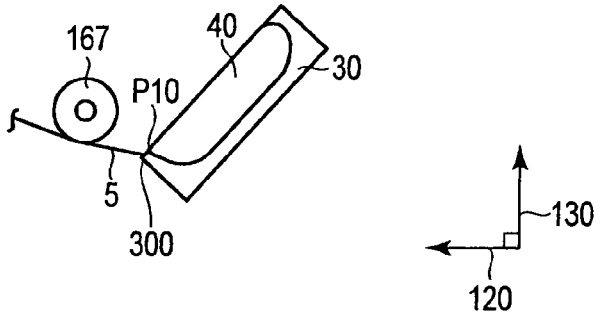
FIG. 17 is a plan view showing, in the same manner as FIG. 13, a state where the bobbin is rotated from the initial position by the first rotating unit, and a second rotating unit.
Figure 18:
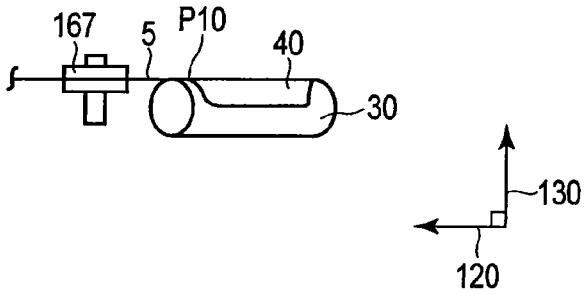
FIG. 18 is an explanatory view showing a state where the bobbin is rotated by the first and second rotating units around the second axis from the initial position, and is rotated around the third axis as viewed along the third axis.

FIG. 17 is a plan view showing, in the same manner as FIG. 13, a state where the bobbin 40 is rotated by the first and second rotating units 140, and 150 from the initial position around the second axis 120 by an angle θy, and is rotated around the third axis 130 by an angle θz. FIG. 18 is a view showing a state where the bobbin 40 is rotated by the first and second rotating units 140 and 150 from the initial position around the second axis 120 by an angle θy, and is rotated around the third axis 130 by an angle θz as viewed along the third axis 130.

As shown in FIGS. 17, and 18, the control unit 200 creates coordinate information about the target position P10 in the state where the bobbin 40 is rotated by the first and second rotating units 140 and 150 around the second axis 120 from the initial position by an angle θy, and is rotated around the third axis 130 by an angle θz. It should be noted that it is assumed that the coordinate information created herein is (x2, y2, z2). The coordinate position (x2, y2, z2) is coordinate information about the movement destination of the pressing section 51 of the head 50.

Figure 19:
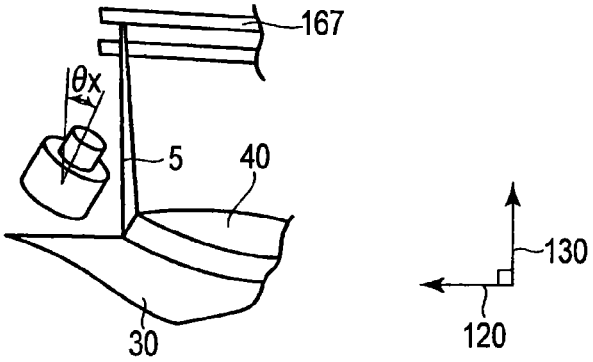
FIG. 19 is a perspective view showing a state where the head is rotated around the first axis by a head rotating unit of the winding apparatus.

As sown in FIG. 19, the rotation angle θx of the pressing section 51 of the head 50 is an angle which makes a part of the circumferential surface of the pressing section 51 on the bobbin 40 side parallel to the target position P10. It should be noted that FIG. 19 is a perspective view showing the state where the bobbin 40 which has been in the initial position is rotated by rotation angles θy and θz by the first and second rotating units 140 and 150, and is rotated by a rotation angle θx by the head rotating unit 100.

The control unit 200 creates angular information about the target position P10 relative to the first axis 110, rotated around the second axis 120 by an angle θy, and is rotated around the third axis 130 by an angle θz from information about the shape of the bobbin 40, angular information items θy and θz, and coordinates (x2, y2, z2). The control unit 200 creates rotation angle information Ox of the pressing section 51 around the first axis 110 on the basis of the created angular information about the target position P10 relative to the first axis 110.

In the above description, creation of the rotation angles θx, θy, and θz for the coordinate information (x1, y1, z1) of the target position P10, and movement destination coordinate information (x2, y2, z2) has been described. Likewise, the control unit 200 creates rotation angle information and movement destination coordinate information in the same manner also for each of the positions of the bobbin 40 described in connection with the first function. Likewise, the control unit 200 creates, in the same manner, rotation angle information and movement destination coordinate information for each of the positions of each layer of the wire 5 wound around the bobbin 40 described in connection with the second function.

The fourth function of the control unit 200 is a function of creating an operation recipe for driving the core rotating unit 135 and head moving unit 60 on the basis of the rotation angle information, and movement destination coordinate information for each of the positions created by the third function, and controlling the core rotating unit 135 and head moving unit 60 in accordance with the operation recipe.

Next, the operation of the winding apparatus 10 of this embodiment will be described below. First, information about the shape of the bobbin 40, for example, design information such as CAD data or the like of the bobbin 40 is input to the control unit 200 by an operator or the like.

When the information about the shape of the bobbin 40 is input, the control unit 200 creates coordinate information about each of the positions of the bobbin 40 in the state where the bobbin 40 is set to the initial position. Further, the control unit 200 creates coordinate information about each of the positions of each layer of the wire 5 on the basis of the thickness of the wire 5, and number of times the wire 5 is wound around the bobbin 40, i.e., the number of the layers of the wire 5 laminated on the circumferential surface of the bobbin 40.

Next, the control unit 200 creates an operation recipe for operating the head moving unit 60 and core rotating unit 135 on the basis of the coordinate information about each of the positions of the bobbin 40 created in the manner described above in order to move the pressing section 51 of the head 50 to each of the positions of the circumferential surface of the bobbin 40, and each of the positions of the circumferential surface of the wire 5 wound around the bobbin 40. The operation recipe is created by the above-mentioned third function.

When the operation recipe for the head moving unit 60, and core rotating unit 135 is created, the operator fixes a distal end of the wire 5 to a fixing part set in advance to the bobbin 40. The fixing part is formed so that the distal end of the wire 5 can be fixed.

When the distal end of the wire 5 is fixed to the bobbin 40, the control unit 200 operates the head moving unit 60 and core rotating unit 135 in accordance with the created operation recipe. The head moving unit 60 and core rotating unit 135 are operated in accordance with the operation recipe, whereby the wire 5 is pressed against the circumferential surface by the pressing section 51 in the state where the posture of the wire 5 is fitted to the circumferential surface as shown in FIGS. 4, 5, 10, and 11. As described above, the head moving unit 60 and core rotating unit 135 are operated in accordance with the operation recipe, whereby the wire 5 is wound around the bobbin 40.

Further, when the wire 5 is wound around the bobbin 40, the upper end of the wire 5 is held down by the guide section 52 as shown in FIG. 8, whereby the wire 5 is wound around the bobbin 40 in the state where the lower end thereof is in contact with the circumferential surface of the core 30 as shown in FIGS. 4, 5, 10, and 11. That is, the wire 5 is wound around the bobbin 40 while following the circumferential surface of the core 30.

The winding apparatus 10 configured in the manner described above can obtain an advantage identical to the first embodiment. Furthermore, the operation recipe for controlling the head moving unit 60 and core rotating unit 135 is formed in such a manner that the part of the wire 5 from the fixed feed roller 167 to the pressing section 51 becomes parallel to the tangential direction of the part of the bobbin 40 at which the pressing section 51 is pressed.

Accordingly, there is no need to provide a feed position moving section 166 configured to move the feed roller 167, and hence it is possible to simplify the configuration of the winding apparatus 10.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A winding apparatus comprising:

a bobbin;

a core on which the bobbin is to be fixed;

a pressing section configured to press a wire against the bobbin;

a moving unit configured to move the pressing section relatively to the core along each of first to third axes perpendicular to each other;

a first rotating unit configured to rotate the pressing section relatively to the core around fourth and fifth axes perpendicular to each other, and set on the core;

a second rotating unit configured to rotate the pressing section relatively to the core around a sixth axis which becomes parallel to, when the core is in an initial position at which the fourth and fifth axes become parallel to any two of the first to third axes, a remaining one of the first to third axes; and a control unit configured to control an operation of the moving unit, and operations of the first and second rotating units.

2. The winding apparatus according to claim 1, wherein the moving unit comprises a first moving section configured to move the pressing section along the first axis, a second moving section configured to move the pressing section along the second axis, and a third moving section configured to move the pressing section along the third axis, and the first rotating unit comprises a first rotating section configured to rotate the core around the fourth axis, and a second rotating section configured to rotate the core around the fifth axis.

3. The winding apparatus according to claim 1, further comprising a guide section configured to maintain a height of the wire relative to a circumferential surface of the core at a preset height.

4. A winding apparatus according to claim 1, further comprising:

a wire feeding section configured to feed the wire to the pressing section; and a wire feeding section moving section configured to move the wire feeding section, wherein the control unit moves the wire feeding section moving section in such a manner that a part of the wire extending from the wire feeding section to the pressing section becomes parallel to a tangential direction of a position of the bobbin at which the wire is pressed against the bobbin by the pressing section.

5. A winding method comprising:

moving a pressing section configured to hold a wire between a bobbin and the pressing section to a target position set to the bobbin by adjusting a position of the pressing section relative to the bobbin;

adjusting an inclination of the pressing section configured to hold the wire between the bobbin and the pressing section in accordance with an inclination of a surface of the bobbin at a target position;

moving the pressing section to the target position by moving the pressing section relatively to the bobbin along a first axis, moving the pressing section relatively to the bobbin along a second axis perpendicular to the first axis, moving the pressing section relatively to the bobbin along a third axis perpendicular to the first and second axes, rotating the pressing section relatively to the bobbin around a fourth axis set to the bobbin, and rotating the pressing section relatively to the bobbin around a fifth axis perpendicular to the fourth axis set to the bobbin on the basis of coordinate information about the target position of the bobbin; and adjusting an inclination of the pressing section configured to hold the wire between the bobbin and the pressing section in accordance with an inclination of a surface of the bobbin at a target position by rotating the pressing section relatively to the bobbin around a sixth axis which becomes parallel to, when the bobbin is in an initial position at which the fourth and fifth axes become parallel to any two of the first to third axes, a remaining one of the first to third axes on the basis of the coordinate information about the target position of the bobbin.

6. The winding method according to claim 5, further comprising pressing the pressing section against the bobbin.

* * * * *